US007736537B1

(12) United States Patent
Zastrow et al.

(10) Patent No.: US 7,736,537 B1
(45) **Date of Patent: *Jun. 15, 2010**

(54) REPLACEMENT SOLVENTS HAVING IMPROVED PROPERTIES FOR REFRIGERATION FLUSHES

(75) Inventors: Dustin Zastrow, Indialantic, FL (US); John Meyer, Palm Bay, FL (US); Lisa Patton, Melbourne, FL (US)

(73) Assignee: Mainstream Engineering Corp., Rockledge, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/243,042

(22) Filed: Oct. 1, 2008

Related U.S. Application Data

(63) Continuation-in-part of application No. 12/018,832, filed on Jan. 24, 2008.

(51) Int. Cl.
*B01F 1/00* (2006.01)

(52) U.S. Cl. ..... 252/364; 510/405; 510/108; 134/22.1; 134/22.14

(58) Field of Classification Search ..... 252/364; 510/108, 405; 134/22.1, 22.14
See application file for complete search history.

(56) References Cited

U.S. PATENT DOCUMENTS

| | | | | |
|---|---|---|---|---|
| 4,999,127 | A | 3/1991 | Merchant | |
| 5,035,828 | A | 7/1991 | Tamura et al. | |
| 5,174,906 | A * | 12/1992 | Henry | 210/765 |
| 5,273,592 | A | 12/1993 | Chi Li | |
| 5,336,429 | A * | 8/1994 | Barthelemy et al. | 510/411 |
| 5,610,132 | A * | 3/1997 | Momoda et al. | 510/506 |
| 5,611,210 | A * | 3/1997 | Nimitz et al. | 62/114 |
| 5,750,046 | A * | 5/1998 | Wheeler | 252/68 |
| 5,759,430 | A * | 6/1998 | Tapscott et al. | 252/8 |
| 5,900,185 | A * | 5/1999 | Tapscott | 252/67 |
| 6,020,298 | A | 2/2000 | Silvani et al. | |
| 6,060,439 | A * | 5/2000 | Doyel et al. | 510/164 |
| 6,063,314 | A | 5/2000 | Chadwick | |
| 6,291,417 | B1 | 9/2001 | Flynn et al. | |
| 6,297,308 | B1 | 10/2001 | Jariwala et al. | |
| 6,300,378 | B1 * | 10/2001 | Tapscott | 514/743 |
| 6,387,506 | B1 * | 5/2002 | Kawamura et al. | 428/413 |
| 6,402,857 | B2 | 6/2002 | Clark et al. | |
| 6,689,734 | B2 * | 2/2004 | Doyel et al. | 510/410 |
| 2006/0166851 | A1 * | 7/2006 | Grzyll et al. | 510/407 |
| 2008/0227668 | A1 * | 9/2008 | Welton | 507/239 |

OTHER PUBLICATIONS

STIC search result.*

Robert E. Tapscott et al. "Tropodegradable Fluorocarbon Replacements For Ozone-Depleting And Global-Warming Chemicals" Journal of Fluorine Chemistry 101 (2000) 209-213.

* cited by examiner

*Primary Examiner*—Harold Y Pyon
*Assistant Examiner*—Haidung D Nguyen
(74) *Attorney, Agent, or Firm*—Crowell & Moring LLP

(57) ABSTRACT

Chlorofluorocarbon replacement solvents include a main component (first solvent) and a property-modification component (second solvent). The resulting solvent mixtures meet or exceed the solvency, flammability, and compatibility requirements for CFC's while providing similar or improved environmental and toxicological properties. These solvent mixtures can be used in conjunction with refrigeration or heat pumps, electronics, implantable prosthetic devices, oxygen systems, and optical equipment.

14 Claims, No Drawings

REPLACEMENT SOLVENTS HAVING IMPROVED PROPERTIES FOR REFRIGERATION FLUSHES

CROSS-REFERENCE TO RELATED APPLICATIONS

This application is a continuation-in-part of U.S. application Ser. No. 12/018,832, filed on Jan. 24, 2008, entitled "Replacement Solvents Having Improved Properties for Refrigeration Flushes", which is incorporated herein by reference in its entirety.

BACKGROUND AND SUMMARY OF THE INVENTION

Chlorofluorocarbons (CFC's) are widely used solvents for precision cleaning of parts and components due to their advantageous physical and chemical properties, especially their solvency for contaminating materials such as oils, greases, resins, fluxes, particulates, and other contaminates. Examples of such solvents commonly used in many applications are CFC-113 (1,1,2-trichloro-1,2,2-trifluoroethane) and CFC-11 (trichlorofluoromethane). These solvents are used to clean and/or degrease components or systems related to, but not limited to, oxygen handling systems, refrigeration equipment, heat pumps, electronics, implantable prosthetic devices, and optical equipment.

A refrigeration or air conditioning system, for example, may have drastically reduced performance resulting from compressor failure caused by retained contaminants. Such systems require periodic flushing to remove contaminants such as oil, water, acid and sludge. The need to properly clean these contaminated systems is very important and trichlorofluoromethane (CFC-11) has been found to be an effective and versatile solvent. Being able to dissolve an unusually large array of contaminants and having excellent physical characteristics, CFC-11 became the 'solvent-of-choice' for refrigeration flushing and its use spread to other applications.

CFC-113 and CFC-11 have also been used to measure residue remaining in a system. For example, in Air Force launch vehicle applications involving liquid or gaseous oxygen systems where residual contamination can be catastrophic, CFC-113 has been used to detect and quantify the amount of hydrocarbon and fluorocarbon residues. Both of these chlorofluorocarbons are also commonly-used for foam blowing and polymer coating.

CFC-113 and CFC-11 have many favorable characteristics such as low toxicity, non-flammability and stability. Furthermore, they are not classified as air-polluting volatile organic compounds (VOC's) by environmental regulators and have a high worker exposure threshold value, thus eliminating the need for costly air circulation or dilution precautions. Due to concerns over worker safety from toxic chemical exposure and hazardous waste disposal resulting from the use of VOC's, these desirable characteristics led to the widespread use of CFC-113 and CFC-11.

However, by the mid 1980s, problems relating to the ability of certain halogenated hydrocarbons to react with and deplete atmospheric ozone became apparent. As a result, the use of CFC-113 and CFC-11 was restricted under the Montreal Protocol. In 1987, twenty-four nations agreed in principle to control ozone-depleting substances (ODS). Although CFC solvents had become critical in industry, the importance of protecting the earth's ozone layer weighed heavier. Thus, non-toxic and non-ozone depleting replacement solvents became a priority for refrigeration technicians, electronics manufacturers, and the military.

Because CFC-113 and CFC-11 possess so many desirable properties, those skilled in the art have attempted to find replacements with limited success, most believing that a replacement solvent must compromise on some performance properties.

Many factors are important when selecting CFC replacement solvents. Some of the performance properties for a CFC replacement include cleaning effectiveness or solvency, volatility (e.g., boiling point), compatibility with materials to be cleaned (e.g. metals, elastomers and systems), toxicity (e.g., LC50, LD50, cardiac sensitization, mutagenicity, skin irritation), environmental persistence (e.g., ozone depletion potential (ODP), global warming potential (GWP), biodegradability, flammability (flash point), cost and availability.

Hazardous risks such as toxicity, environmental impact and flammability are important since the replacements will likely be used in large volumes as manufacturers transition away from CFC-113 and CFC-11. The hazard potential of the candidate replacements can be characterized using toxicity information such as lethal doses (LD), lethal concentrations (LC) or threshold limit values (TLV), and flammability information. Environmental properties can be analyzed through ozone depletion potential (ODP) and global warming potential (GWP). Volatility can be assessed using the normal boiling point (nBP) of the solvent. For a discussion of toxicity and environmental parameters, see e.g., U.S. Pat. No. 6,300,378. The following paragraphs discuss the relevance of these performance parameters.

Cleaning Effectiveness or Solvency

The cleaning effectiveness of CFC-11 is unique in that it is able to dissolve and absorb an array of different materials like oils, greases and acids. The solvency of the replacement should be comparable to CFCs so that this primary metric of performance is not compromised.

Volatility

The volatility of a replacement solvent can be measured in terms of its normal boiling point (nBP). The volatility of the replacement solvent should be similar to CFCs so there is minimal impact on existing cleaning systems by switching solvents. For example, an effective solvent should be volatile enough to evaporate, but should not flash off of surfaces since the solvent preferably remains in contact with contaminants long enough to dissolve them.

Compatibility

Material and system compatibility is another desired property for a replacement solvent. The solvent is preferably compatible with metals such as aluminum, copper, carbon steel and stainless steel, as well as elastomers. The solvent should not degrade or corrode surfaces in the system being cleaned.

Toxicity

Parameters such as the lethal dose 50 (LD50), lethal concentration 50 (LC50), cardiac sensitization, skin irritation, and mutagenicity (e.g., via the Ames test) can be used as toxicity metrics. The LDn or LCn abbreviations, where n is the percent lethality, are used for the dose of a toxicant lethal to n % of a test population. For example, at LD50, 50% of the recipients of that particular toxic dose would die. Cardiac sensitization is a measure of the ability of a compound to cause cardiac arrhythmia under stress. Generally, it is desired to minimize these parameters and select compounds that have lower values than the solvent that is being replaced.

Environmental Persistence

The environmental persistence of a solvent is also very important. Parameters such as the ozone depletion potential (ODP) and global warming potential (GWP) are measures of this attribute. ODP and GWP give the relative ability by weight of a chemical to deplete stratospheric ozone and to contribute to global warming, respectively. Values for ODP and GWP are calculated based on an earth surface release and then reported relative to a reference compound (typically CFC-11 for ODP and CFC-11 or carbon dioxide for GWP). Generally, the ODP should be less than 0.02, and the GWP should be minimized, preferably lower than the solvent being replaced.

The biochemical oxygen demand (BOD) is another measure of persistence typically in groundwater, lakes, and other bodies of water.

Flammability: Flashpoint

Whether a solvent is suitable as a cleaning solvent is partially dependent upon its flammability, which can be quantified by the flashpoint of the solvent. The flashpoint is the temperature at which a liquid gives off vapor sufficient to form an ignitable mixture with air (oxygen) near the surface of the liquid. The ideal replacement refrigeration solvent should have a flashpoint greater than about 40° C. This categorizes the solvent as not flammable and insures a wide range of conditions whereby the solvent can be used safely. If the product will be sold in an aerosol can, other flammability tests must be performed.

CFC-113 and CFC-11 replacements and solvents that address ozone depletion have been introduced and are disclosed, for example, in U.S. Pat. Nos. 5,035,828, 6,402,857, 6,297,308, and 6,020,298. Various solvents and solvent mixtures are disclosed which have low ODPs. These replacement solvents, however, do not possess all of the desired properties of CFC-11 or CFC-113, such as cleaning effectiveness, oxygen compatibility, toxicity and flammability.

In U.S. Pat. No. 5,035,828, HCFC-234 is combined with an aliphatic alcohol or cyclohexane, but this mixture is easily flammable. U.S. Pat. No. 6,402,857 utilizes n-propyl bromide with other organic constituents, which are also flammable and have a significant adverse impact on ozone. U.S. Pat. No. 6,020,298 utilizes hydrofluoropolyethers, and U.S. Pat. No. 6,297,308 utilizes halogenated ethers and hydrocarbons with a surfactant. While these solvents appear to avoid damage to the ozone layer, the perfluorinated compounds contained therein are known to be potent greenhouse gases.

Solvents that meet some environmental restrictions and are non-flammable are disclosed in U.S. Pat. Nos. 6,300,378 and 5,759,430 and in Tapscott & Mather, "Tropodegradable Fluorocarbon Replacements for Ozone-Depleting and Global-Warming Chemicals," J. Fluorine Chemistry 101:209-213 (2000). The compounds disclosed therein are generally non-ozone depleting and/or non-flammable, as they are "tropodegradable fluorocarbons," which are defined as compounds having structural weaknesses to ensure rapid decay in the troposphere.

When tropodegradable fluorocarbons are exposed to sunlight or chemical radicals (e.g., hydroxyls) in the atmosphere, they decay into forms that do not damage the ozone layer or contribute to the greenhouse effect. This structural weaknesses can take such forms as hydrogen being present in the molecule, a vulnerable carbon-carbon double bond, an ether bond, or a bromine atom being present for easy degradation. These structural vulnerabilities render the molecules unstable, and within a fairly short period of time they break down and are no longer part of the atmosphere. The foregoing references, however, fail to teach solvents with optimized solvency, together with desirable toxicity, and material compatibility.

Additional solvents are disclosed in U.S. Pat. Nos. 6,291,417, 5,273,592, 5,174,906, and 4,999,127. Commonly-owned U.S. patent application Ser. No. 11/043,091 discloses a list of replacement solvents for CFC-113.

Commercially-available products that are used as refrigeration flushes and claim to be replacements for CFC-11 include RX-11 and Supercool. RX-11 is marketed by Nu-Calgon. Supercool is used in automotive air conditioning units.

One object of the present invention is to provide CFC solvent replacements preferably comprising at least two tropodegradable components that act collectively to provide solvent mixtures that have improved cleaning effectiveness or solvency with respect to the CFC targeted for replacement, boiling points greater than about 40° C., compatibility with common elastomers and metals, toxicities less than or similar to the CFC targeted for replacement, ODP values less than about 0.02, and are not flammable as measured by flashpoint testing.

Regarding the requirement for cleaning effectiveness/solvency, the inventive solvent mixture advantageously can absorb impurities contained in a refrigeration system including oil, acid and moisture. According to a preferred embodiment, the solvent mixture includes at least one alcohol, which is an effective water and acid absorber. In this regard, the smaller chained alcohols such as ethanol and propanol are preferred because they absorb the most moisture per unit volume. The larger chained alcohols on the other hand, although less efficient at trapping water, are less flammable than the short chained alcohols.

Because contaminated oil is generally the major impurity that is to be flushed from system lines, the solvent mixture preferably comprises a hydrocarbon as a main component. Oil, which is also a hydrocarbon, is most readily dissolved by a hydrocarbon-containing solvent mixture.

Regarding flammability, the flash point of the solvent mixture is preferably greater than about 40° C. (100° F.) in order for the solvent mixture to be classified not flammable and be considered safe to use in refrigeration systems. Another flammability test must be passed if the product will be sold in an aerosol can. It is still important for the material to have a flashpoint above 40° C., but in order for the solvent to be considered non-flammable, it must pass the aerosol flammability test. The main test that must be passed is the flame extension test. The aerosol bottle is held 6 inches away from an ignition source (e.g. paraffin candle) and sprayed over the flame. This is done at a variety of valve openings. If, at any valve opening, the flame flashes back to the valve stem; or at full valve opening, the flame projects 18 inches or more, the product is considered flammable. If there is flashback at full valve opening, the product is considered very flammable. Any projection under 18 inches classifies the aerosol as non-flammable.

Yet another object of this invention is to provide replacement solvent mixtures to clean and/or degrease components or systems related to, but not limited to, refrigeration systems, heat pumps and air conditioning units.

Non-flammable solvent mixtures and/or solvent mixtures having reduced flammability can be prepared by adding a property-modification solvent selected from Table 1 to a main solvent. Also, solvent mixtures having improved acid and water absorption properties can be prepared by adding a property-modification solvent selected from Table 1 to a main solvent such as alcohols, glycols, esters or ketones.

DETAILED DESCRIPTION OF PREFERRED EMBODIMENTS

The invention relates to a solvent mixture comprising one or more main components, e.g., one or more first solvents, and one or more property-modification components, e.g., one or more second solvents. By combining a property-modification component with the main component, it is possible to produce a cost-effective replacement solvent having specifically tailored properties.

According to one embodiment, the invention relates to improved refrigeration replacement solvent mixtures that possess important performance properties relating to:

1) Cleaning effectiveness or solvency;
2) Volatility (boiling point);
3) Compatibility (metals, elastomers, systems);
4) Toxicity (e.g., $LC_{50}$, $LD_{500}$, cardiac sensitization, skin irritation, mutagenicity);
5) Environmental persistence (e.g., ozone depletion potential (ODP), global warming potential (GWP), biodegradability);
6) Flammability (flash point); and
7) Cost & availability.

The solvent mixtures according to the present invention preferably have improved cleaning effectiveness or solvency with respect to the CFC targeted for replacement, a boiling point greater than about 40° C., compatibility with common elastomers and metals, toxicity less than or similar to the CFC targeted for replacement, an ODP value less than about 0.02, and a flashpoint greater than 40° C.

The main component (first solvent) is preferably selected from the group consisting of alcohols (e.g., ethanol, n-propanol or n-butanol), terpenes (e.g. d-limonene), glycols (e.g. propylene glycol), glymes (e.g. tetraglyme, dipropylene glycol dimethyl ether), alkanes, alkenes, esters, ethers, ketones, aromatics, haloaromatics, haloalkanes (e.g. 1-bromo-2-methylpropane, 1-bromo-3-chloropropane), haloalkenes, and cycloalkanes.

A preferred first solvent is d-limonene, which is derived from the oil of citrus fruit rinds. It is an effective solvent with a solubility parameter close to that of CFC-11. It is also a stable molecule which makes it attractive for use in refrigeration units. Its flash point is around 120° F. Its evaporation rate is not as high as most commercially-available products, but it is high enough such that residue left behind from the solvent can be eliminated with a post-flush nitrogen purge. Its evaporation rate is low enough to ensure that it will be able to move through the entire system and not totally evaporate before it reaches the end of the lines.

Based on the efficacy of d-limonene, combinations of d-limonene and alcohols were selected in order to find an appropriate blend where the mixture was not flammable (flash point >40° C.). Alcohols are preferred due to their hygroscopic properties. Ethanol and isopropyl alcohol have flash points of 55° F. and 54° F., respectively. Combinations of both ranging from 20 wt. % alcohol, 80 wt. % d-limonene to 80 wt. % alcohol, 20 wt. % d-limonene were tested with a Koehler closed cup flash point tester. Each of these combinations resulted in a mixture that was flammable.

In addition to alcohols, tetraglyme, which is a glycol diether, can also absorb water. Tetraglyme has a high flash point, which also makes it a viable flushing component. A disadvantage of using tetraglyme in flushing applications, however, is that is does not evaporate quickly, and even following a nitrogen purge, a residue can be left behind during flushing experiments. Despite the residue, tetraglyme mixed with d-limonene at percentages ranging from 30-40 wt. % tetraglyme and 60-70 wt. % d-limonene possessed all of the important characteristics of a replacement solvent excluding its volatility.

The compound dipropyleneglycol dimethylether, which is similar to tetraglyme, is another choice as main component. It can be used as a direct replacement for d-limonene. The flash point of dipropyleneglycol dimethylehter is 149° F. Its volatility is very similar to that of d-limonene, but the advantage to using dipropyleneglycol dimethylether is that it absorbs water and acid in much larger percentages.

If the product will be placed in an aerosol and combined with R-134a, 1-bromo-2-methylpropane is an attractive choice as a main component. The compound 1-bromo-2-methylpropane is flammable in its pure state, but when mixed with a non-flammable propellant, it can make aerosols non-flammable. Another characteristic of this component is that it has a lower boiling point than any of the previously mentioned main components which makes its evaporation rate favorable. Unlike many of its halogenated alkane relatives, 1-bromo-2-methylpropane is non-toxic and non-ozone depleting. The chemical also has solvency characteristics similar to that of CFC-11.

Another haloalkane, 1-bromo-3-chloropropane, is a suitable main component of a flushing product. A disadvantage is that 1-bromo-3-chloropropane is considered to be a poison if ingested. This means it does not meet all criteria to be an ideal replacement solvent, but there should be no chance of ingestion if the product is used properly. All other qualities of the compound make it a good main component for the flush. Other haloalkanes that would be main component candidates include but are limited to 1-bromopropane, 1-bromobutane, 1-bromopentane, 1-bromo-3-methylbutane, isoamyl bromide, 1-bromohexane 1-bromo-2,5-difluorobenzene, 1-bromo-3,5-difluorobenzene, 2-bromoethyl ethyl ether, 2-bromo-2-methyl butane, 3-bromopentane, 5-bromo-1-pentene, 1-bromo-1-propene, 1-bromo-6-chlorohexane, 1-bromobenzene, 1-bromooctane, and 1-bromoundecane. Generally, these compounds were more expensive than compared to the previous compounds talked about in more detail.

While the foregoing main component solvents have proven to be very effective and similar to CFC-113 and CFC-11, we have determined that the combination of two or more solvents can provide improved solvency toward contaminants such as greases and oils since the solvency range can be extended or broadened when compared to a single compound. This suggests that synergies exist when combining compounds identified herein. Such synergies would not have been expected if considering only the individual components of the mixture. It should be recognized that the solvencies of the two or more compounds comprising the solvent mixtures are preferably similar to each other so that the compounds are soluble in each other.

The property modification components are chosen from a list of potential replacement solvents. These compounds included halogenated compounds such as halogenated acetates, alcohols, alkanes, cycloalkanes, alkenes, cycloalkenes, amines, anhydrides, aromatics, carbonyls, diones, esters, ethers, heterocyclics and ketones. Table 1 contains a list of preferred property modification components according to one embodiment, which was prepared based on their properties with respect to the seven characteristics above. Their addition to a solvent mixture can advantageously modify one or more properties of the solvent mixture. CFC-113 is included in Table 1 for comparison purposes only. The boiling point (° C.), global warming potential (GWP), ozone depletion potential (ODP), cardiac sensitization relative to CFC-113 (CS/CS113), and solubility parameter (SP) are listed for each compound in Table 1.

The compounds included in Table 1 all have ODP's of less than 0.02 in order to be unclassified by the EPA as a Class II Ozone Depleting Substance. Cardiac sensitization and toxicity, as determined by a 2 hr or 4 hr LC50 value, were also used as criteria for selection of the property modification components listed in Table 1.

Preferred property modification components according to a further embodiment have the following chemical formula: $C_qH_rBr_xCl_yF_zO_p$, where q=3-10, r=0-11, x=0-1, y=0-2, z>1, and p=0-3. Many of these compounds belong to the classes of hydrofluorochloro-ethers (HFCE's), hydrobromofluorochloro-alkenes (HBFCA's), and hydrofluoro-ethers (HFE's). This formula also incorporates compounds in the families of alkanes, alcohols, diones, acetates, ketones (e.g., butanones, pentanones), esters (e.g., propanoates), anhydrides, cycloalkanes (cycloparaffins), cycloalkenes (cycloolefins), heterocyclics (e.g., furans), and aromatics. As illustrated in Table 1, all of these individual compounds meet the performance requirements set forth herein. In general, the compounds of Table 1 are halogenated solvents with or without the heteroatom bromine.

According to yet a further embodiment, when d-limonene is selected as a main component, the property modification component is preferably an alcohol or tetraglyme.

In an embodiment wherein the main solvent is d-limonene and the property-modification solvent is isoflurane, the solvent mixture can further comprise 1-butanol and optionally R-134a. In an embodiment wherein the solvent mixture consists essentially of 85 wt. % d-limonene, 8 wt. % isoflurane and 7 wt. % 1-butanol, the solvent mixture can additionally consist of R-134a, with percentages of 65.4 wt. % d-limonene, 6.2 wt. % isoflurane, 5.4 wt. % 1-butanol, and 23 wt. % R-134a.

In an embodiment wherein the main solvent is dipropyleneglycol dimethylether and the property-modification solvent is isoflurane, the solvent mixture can further comprise 1-butanol. In an embodiment, the solvent mixture consists essentially of 85 wt. % dipropyleneglycol dimethylether, 8 wt. % isoflurane and 7 wt. % 1-butanol. In an embodiment wherein the main solvent is 1-Bromo-2-methylpropane and the property-modification solvent is isoflurane, the solvent mixture can further comprise n-propanol. In an embodiment, the solvent mixture consists essentially of 45 wt. % 1-Bromo-2-methylpropane, 4 wt. % isoflurane and 5 wt. % n-propanol, and 46 wt. % R-134a. In an embodiment wherein the main solvent is 1-Bromo-3-chloropropane and the property-modification solvent is isoflurane, the solvent mixture can further comprise ethanol. In an embodiment, the solvent mixture consists essentially of 47 wt. % 1-Bromo-3-chloropropane, 5 wt. % isoflurane and 13 wt. % ethanol, and 35 wt. % R-134a. The flammability of solvents containing brominated compounds can be reduced by using R-134a as a propellant.

Referring to Table, 1 the ODP for CFC-113 is much higher than 0.02, classifying it as a Class II Ozone Depleting Substance. The GWP of CFC-113 is 5000, and the toxicity of CFC-113 is also typically higher than those compounds shown in Table 1. Some of the compounds listed in Table 1 have many properties improved over CFC-113 while having the same or similar solvency properties.

We have discovered that although some of the property modification components listed in Table 1 can meet or exceed some of the performance properties of CFC-11 and CFC-113, the solvency toward a variety of greases and contaminants was inferior to either CFC-11 or CFC-113 and other single component replacement solvents. By combining the property modification components with a main component to form a solvent mixture, however, solvent mixtures could be tailored to provide optimized solvency toward a range of contaminant types. Other properties such as volatility and flammability can also be tailored in this manner.

Some of the property modification components shown in Table 1 have solubility parameters and boiling points that are similar to CFC-11 (solubility parameter of 7.2, boiling point of 47.6° C.). D-limonene has a solubility parameter of 8.32. By combining d-limonene and a property modification component from Table 1, for example, the range of solvency of the resulting solvent mixture can be tailored to approximate the solubility parameter of CFC-113, meaning that the same impurities should be able to be absorbed.

In addition to the foregoing, we have also discovered surprisingly that the brominated property modification components, if included, can advantageously impact the solvency properties of the solvent mixture so that the solvent mixture performs similar to or better than the CFC targeted for replacement. For example, by incorporating one or more brominated compounds into the solvent mixture, the solvency range for certain common contaminants (e.g., hydrocarbon and fluorocarbon greases, oils, and decomposition products) can be increased with respect to the CFCs targeted for replacement. Certain brominated compounds are also known to offer reductions in flammability. See commonly-owned U.S. patent application Ser. No. 11/043,091.

Based on their solvency, ODP, boiling point, and toxicity parameters, particularly preferred property modification components are those with one bromine atom. Compounds with multiple bromine atoms were considered, but these compounds and solvent mixtures comprising these compounds were inferior to those containing just one bromine atom.

In another aspect, a further class of compounds that can be included in the solvent mixture as property-modifiers are those that have generally been used as anesthetics, or as intermediates used to produce anesthetics. Examples of these halogenated ether compounds include, but are not limited to, isoflurane (1-chloro-2,2,2-difluoroethyl difluoromethyl ether), enflurane (2-chloro-1,1,2-trifluoroethyl difluoromethyl ether), desflurane (2-(difluoromethoxy)-1,1,1,2-tetrafluoro-ethane), sevoflurane (fluoromethyl 2,2,2-trifluoro-1-(trifluoromethyl)ethyl ether), methoxyflurane, and methyl 2,2,2-trifluoroethyl-1-trifluoromethyl ether.

We have found that the foregoing anesthetics and anesthetic intermediates, when incorporated into the solvent mixtures according to the invention, have additional advantages with respect to solvency and boiling point. Also, these compounds have been extensively tested for toxicity and mutagenicity by the medical community and pose minimal risk with regard to health.

Generally, the solvent mixture according to the invention comprises at least 60 wt. % of a main component (e.g., 60, 65, 70, 75, 80, 85, 90 or 95 wt. %) and up to 40 wt. % of one or more property modification components (e.g., 5, 10, 15, 20, 25, 30, 35 or 40 wt. %. According to one preferred embodiment, the solvent mixture comprises from 60-99 wt. % (e.g., 60-90 wt. % or 75-85 wt. %) of a main component and from 1-40 wt. % (e.g., 10-40 wt. % or 15-25 wt. %) of a property modification component.

In solvent mixtures comprising more than one property modification component, it is preferred that at least one of the plural property modification components is an alcohol. A solvent mixture can comprise from 1-15 wt. % of an alcohol as a property modification component.

One particularly preferred solvent mixture comprises 66 wt. % d-limonene and 34 wt. % tetraglyme. Another particularly preferred solvent mixture comprises 85 wt. % d-limonene, 8 wt. % isoflurane, and 7 wt. % 1-butanol. These percentages become 65.5 wt. % d-limonene, 6.2 wt. % isoflurane, 5.4 wt. % n-butanol, and 23% R-134a. Utilizing this same formulation but substituting dipropyleneglycol dimethylether in for d-limonene is yet another preferred embodiment. Brominated compounds were also considered as the main component. A mixture of 47 wt. % 1-bromo-3-chloropropane, 5 wt. % isoflurane, 12 wt. % ethanol, and 36 wt. % R-134a is a preferred flush including a bromine atom. Finally, 45 wt. % 1-bromo-2-methylpropane, 4 wt. % isofluane, 5 wt. % n-propanol, and 46 wt. % R-134a is another preferred solvent mixture.

EXAMPLES

A solvent mixture of 85 wt. % d-limonene, 8 wt. % isoflurane, and 7 wt. % 1-butanol was prepared. This mixture was then put into a can and pressurized with R-134a in the overall amount of 20% (Mixture A). The exact same formulation, with the exception of replacing d-limonene directly with dipropyleneglycol dimethylether was also prepared for testing (Mixture B). Yet another mixture, Mixture C, was tested which was made up of 73% 1-bromo-3-chloropropane, 8% isoflurane, and 19% ethanol. This was combined with R-134a in the amount of 36%, to get the final percentages by mass to be 47% 1-bromo-3-chloropropane, 5% isoflurane, 12% ethanol, and 36% R-134a. Finally, 1-bromo-3-chloropropane was replaced with 1-bromo-2-methylpropane (isobutyl bromide). The ending weight percents in the aerosol can were 45% 1-bromo-2-methylpropane, 4% isoflurane, 5% n-propanol, and 46% R-134a (Mixture D). The following tests were performed on these solvent mixtures, along with competitors Rx-11, Supercool, and the solvent being replaced, CFC-11.

Test 1—Cleaning Effectiveness/Solvency

This test simulated an actual flushing of a refrigeration system. A heat exchanger that closely represented the piping of a small air conditioning unit was used as the testing device. The exchanger was first cleaned with hexane to remove any contamination and then 30 g of oil was added. An initial nitrogen-air purge was blown through the piping of the exchanger. After oil stopped exiting the system, a known mass (50 g) of solvent was introduced into the system. In order to evacuate any material remaining in the exchanger, a final nitrogen purge was performed. In order to assess how well each solvent cleaned the system, 10 g of hexane was introduced into and blown through the system. The fluid was captured in a flask and dried for 30 minutes at 150° F. to evaporate off the hexane. The remaining fluid in the flask was the amount of residual oil left behind after the flush was complete. The results are shown in Table 2.

TABLE 2

| | Oil added (g) | Solvent added (g) | Amount of Residual Oil (g) |
|---|---|---|---|
| Mixture A | 30 | 50 | 0.4 |
| Mixture B | 30 | 49 | 0.26 |
| Mixture C | 30 | 48 | 0.11 |
| Mixture D | 30 | 49 | 0.26 |
| Rx-11 | 30 | 47 | 1.26 |
| SuperCool | 30 | 48 | 2.0 |
| CFC-11 | 30 | 50 | 5.5 |

Test 2—Moisture Retention

Each solvent (5 g) was put into a small vial and the individual samples were titrated with a Karl Fischer titration machine to evaluate how much moisture was contained in each. De-ionized water (1 g) was then added to each vial, which ensured that each sample was saturated with moisture. The samples were then agitated and allowed to phase separate. Karl Fischer analysis of the organic layer of each solvent was performed after phase separation was complete. Results are shown in Table 3.

TABLE 3

| | Starting % | Saturated % | Amount of water absorbed |
|---|---|---|---|
| Mixture A | 0.059% | 0.237% | 0.178% |
| Mixture B | 0.070% | 5.030% | 4.960% |
| Mixture C | 0.030% | 4.850% | 4.820% |
| Mixture D | 0.035% | 0.220% | 0.185% |
| Rx-11 | 0.012% | 0.078% | 0.066% |
| SuperCool | 0.002% | 0.002% | 0.000% |
| CFC-11 | 0.000% | 0.007% | 0.007% |

The difference between the saturated moisture percent and the starting sample moisture percent is the amount that was absorbed by the solvent.

Test 3—Acid Retention

In order to measure the ability of each solvent to absorb acid, a titration of each solvent before and after concentrated HCl addition was performed. The difference between how much titrant was needed to neutralize the solvent after the addition of acid and the amount of titrant needed to neutralize the initial solvent was a simple way to determine how much acid was absorbed by each solvent. Mixture A advantageously absorbed more mineral acid than any of the three comparative solvents. The results are shown in Table 4.

TABLE 4

| | Acid Number before acid (mg/L) | Acid Number after acid (mg/L) | Acid Absorbed (mg/L) |
|---|---|---|---|
| Mixture A | 129 | 471 | 343 |
| Mixture B | 15 | 1623 | 1608 |
| Mixture C | 7 | 959 | 951 |
| Mixture D | 9 | 483 | 474 |
| Rx-11 | 9 | 75 | 66 |
| SuperCool | 26 | 15 | −11 |
| CFC-11 | 9 | 18 | 9 |

*Absorption of acid not observed.

Test 4—Oil Retention

An oil absorption test was performed on Mixtures A, B, C, D and the three comparative solvents to see if there was a saturation point associated with any of the solvents. A 4.5 g sample of each solvent was put into a vial and oil was added to each until a phase separation or other noticeable fluid property change took place. Mixtures A, B, C, D, CFC-11, and SuperCool had no saturation point for oil. Rx-11 and oil phase separated after 0.45 g, or 10 mass % of oil were added.

Test 5—Materials Compatibility

Compatibility tests were performed on metals and gasket materials that may be present in a refrigeration system. Testing on Mixture A was performed at two different solvent concentrations: 100% Mixture A, which represented what would be in contact with the system briefly while flushing, and 5 wt. % Mixture A and 95 wt. % oil, which represented a very high contamination level in a working HVAC unit. Mixtures B, C, and D were tested at 100% concentration.

A sample of each material was allowed to stand exposed to one of the foregoing solvent concentrations for one week before evaluating compatibility. Aluminum, brass, carbon steel, and stainless steel were unaffected by either concentration, while copper tubing was discolored after a week in 100% Mixture A, but was also unaffected by the second trial of 5 wt. % Mixture A and 95 wt. % oil. Teflon, polyurethane, viton, silicon, and latex were all unaffected by 100% A. Buna-n and butyl rubbers showed a very small decrease in weight, which could have been due to a contaminant that was removed by the solvent. The mixture of oil and solvent produced results where a small increase in sample weight was noticed for most of the materials mentioned above. No degradation was found for any sample. Similar results for mixtures B, C, and D were found. All were completely compatible with metals and Teflon. Any increase or decrease in weight noticed over the course of the week for other materials was considered to be negligible considering the flush will be in contact with the actual components for a very short amount of time in 100% concentration.

Test 6—Flash Point

A Koehler closed cup tester was used to determine the flash point. A requirement of refrigeration technicians is that the solvent not be flammable, which means the flash point is preferably greater than 40° C. This ensures that refrigeration line brazing can be performed safely after flushing.

As a preliminary test, mixtures of d-limonene with different amounts of short-chained alcohols (ethanol, isopropanol) were tested. These mixtures all had flash points less than 40° C. Next, a mixture of d-limonene and tetraglyme (tetraethylene glycol dimethyl ether) was tested. Tetraglyme is believed to be a substitute for alcohol due to its ability to absorb water. Moreover, the flash point of tetraglyme is much higher than that of an alcohol. A mixture of 34 wt. % tetraglyme and 66 wt. % d-limonene had a flash point of 120° F. While analyses of the flushing capabilities were initially positive, it was determined that tetraglyme evaporated slowly, which most likely would result in an undesired residue being left behind in the lines after flushing.

Mixtures of d-limonene with higher molecular weight alcohols (butanol) were tested. Butanol advantageously has a higher flashpoint than the smaller alcohols tested previously, but it has a smaller water absorption rate. Mixtures comprising from 1-10 wt. % of 1-butanol in d-limonene had flash points very near 40° C. In order to further improve the flashpoint and solvency, a property-modification solvent from Table 1 was added to the butanol-limonene mixture. Isoflurane (1-chloro-2,2,2-trifluoroethyl difluoromethyl ether), which is an anesthetic, was chosen.

Based on a series of flash point tests, it was determined that an 8 wt. % isoflurane, 7 wt. % 1-butanol, and 85 wt. % d-limonene mixture was preferred (Mixture A). This mixture has a flash point of 165° F., and when it is packaged in an aerosol can with R-134a as the propellant (23 mass percent), the flash point increases to over 200° F.

As shown by the test data above, substituting Dipropyleneglycol dimethylether for d-limonene looks to be advantageous. Flash point testing also verified that the solvent mixture (Mixture B) including dipropyleneglycol dimethylether raised the flash point to over 235° F.

Adding a brominated compound to an aerosol product can help in making the product non-flammable when packaged in an aerosol can. The chemical 1-bromo-3-chloropropane was tested to see if it would produce a non-flammable flush. It was found that when the product contained at least 30 weight percent R-134a, the flush became non-flammable, meaning there was less than an 18" flame extension when the ASTM D-3065 test was performed. Since isoflurane was the property modifying compound used before, it was used again in this formulation. The addition of this allowed for different alcohols to be experimented with. Both ethanol and n-butanol were used in flame extension trials. Neither alcohol formed a flammable mixture when combined with the formulation in less than 10 weight percent. It was then decided that since ethanol is completely soluble with water and acid, it was the better choice than n-butanol. After optimizing the percentages of each compound, Mixture C was decided upon to be the best flush.

Another brominated compound, 1-bromo-2-methylpropane was an ideal main component. The flash point of this chemical is 11° C., which makes it more flammable than 1-bromo-3-chloropropane. This set limitations on the amount of propellant and alcohol that could be contained in the flush in order to be non-flammable. The goal was to keep the propellant, R-134a, under 50 weight percent. This eliminated the possibility of using ethanol. The ethanol had too low of a flash point to be able to used along with 1-bromo-2-methylpropane and produce a non-flammable flush. The n-butanol did make a non-flammable product, but the flame extension at small valve openings did produce a flame that was larger than anticipated. Surprisingly, using n-propanol, an alcohol with a flash point and evaporation rate in between ethanol and n-propanol, worked the best when combined with this brominated compound. N-propanol, like ethanol, is completely soluble in water which is an advantage over n-butanol. It was surprising that the alcohol with a lower flash point actually helped with the overall flammability of the end product. The final weight mixture was chosen as Mixture D is described.

As can be seen from the results of each example, all four mixtures are viable replacement solvents for flushing HVAC systems. Each mixture performed better in all categories tested against other competitors.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

TABLE 1

| CHEMICAL NAME | BP (C.) | GWP | ODP | $CS/CS_{113}$ | SP $(cal/cm^3)^{1/2}$ |
|---|---|---|---|---|---|
| 1,1,2-trichlorotrifluoroethane (CFC-113) (comparative) | 47.6 | 5000 | 0.90 | 1.0 | 7.19 |
| 4-bromo-3-chloro-3,4,4-trifluoro-1-butene | 99.7 | 0 | 0.01 | 0.8 | 7.76 |
| 1-chloro-2,2,2-trifluoroethyl difluoromethyl ether (isoflurane) | 48.8 | 200 | 0.02 | 50.2 | 7.58 |

TABLE 1-continued

| CHEMICAL NAME | BP (C.) | GWP | ODP | $CS/CS_{113}$ | SP $(cal/cm^3)^{1/2}$ |
|---|---|---|---|---|---|
| 2-chloro-1,1,2-trifluoroethyl difluoromethyl ether (enflurane) | 56.7 | 330 | 0.02 | 35.5 | 7.71 |
| 1-bromo-2-(trifluoromethyl)-3,3,3-trifluoropropene | 49.3 | 2281 | 0.01 | 49.4 | 6.95 |
| methyl 2,2,2-trifluroethyl-1-(trifluoromethyl)ether | 50.8 | 28 | 0.00 | 107.3 | 7.26 |
| 4-bromo-1,1,1,3,4,4-hexafluoro-2-(trifluoromethyl)-2-butene | 68.1 | 9849 | 0.01 | 103.2 | 6.51 |
| heptafluoropropyl 1,2,2,2-tetrafluoroethyl ether | 41.0 | 597 | 0.00 | 195.7 | 6.62 |
| perfluorodibutyl ether | 110.1 | 33 | 0.00 | 896.2 | 6.65 |
| 4-bromo-1,1,1,4,4-pentafluoro-2-(trifluoromethyl)-2-butene | 61.0 | 7572 | 0.01 | 105.5 | 6.74 |
| methyl perfluorobutyl ether | 51.0 | 480 | 0.00 | 53.5 | 6.75 |
| 3-bromo-1,1,2,3,4,4,4-heptafluorobutene | 47.5 | 422 | 0.01 | 21.9 | 6.75 |
| 1,1,1,4,4-pentafluoro-4-bromo-2-trifluoromethyl-2-butene | 61.0 | 7572 | 0.01 | 105.5 | 6.77 |
| 1-bromo-1,3,3,3-tetrafluoro-2-(trifluoromethyl)-1-propene | 51.9 | 5061 | 0.01 | 71.9 | 6.78 |
| (Z)-1-bromo-perfluoro-2-butene | 48.0 | 2540 | 0.01 | 41.4 | 6.78 |
| 4-bromo-1,1,2,3,3,4,4-heptafluorobutene | 51.5 | 422 | 0.01 | 23.4 | 6.78 |
| (Z)-2-bromo-1,1,1,3,4,4,4-heptafluoro-2-butene | 49.0 | 2540 | 0.01 | 48.6 | 6.79 |
| 3,3,3-trifluoro-bis-2,2-(trifluoromethyl)-1-propanol | 86.1 | 1201 | 0.00 | 40.7 | 6.81 |
| 1,2-(Z)-bis(perfluoro-n-butyl)ethylene | 132.0 | 15 | 0.00 | 1188.5 | 6.81 |
| (E)-2-bromo-1,1,1,3,4,4,4-heptafluoro-2-butene | 49.0 | 2540 | 0.01 | 48.6 | 6.82 |
| 1,1,1,3,3,3-hexafluoro-2-(trifluoromethyl)-2-propanol | 46.0 | 1292 | 0.00 | 61.2 | 6.84 |
| 2H,3H-decafluoropentane (Vertrel XF) | 55.0 | 1300 | 0.00 | 91.5 | 6.84 |
| ethyl-perfluorobutyl ether | 73.0 | 70 | 0.00 | 69.0 | 6.85 |
| (E)-1-bromo-perfluoro-2-butene | 48.0 | 2540 | 0.01 | 41.4 | 6.85 |
| 1,1,1,5,5,5-hexafluoro-2,4-pentanedione | 69.9 | 97 | 0.00 | 140.5 | 6.90 |
| perfluoro-2-butyltetrahydrofuran | 103.0 | 13 | 0.00 | 65.4 | 6.94 |
| 1H,2H,4H-nonafluorocyclohexane | 65.0 | 252 | 0.00 | 18.5 | 7.02 |
| (E)-2-bromo-1,1,1,4,4,4-hexafluoro-2-butene | 45.1 | 1565 | 0.01 | 42.7 | 7.06 |
| 1-bromo-bis(perfluoromethyl) ethylene | 45.1 | 1565 | 0.01 | 42.7 | 7.06 |
| 1-(bromodifluoromethoxy)-2-(trifluoromethyl)-1,3,3,3-tetrafluoro-1-propene | 78.6 | 6104 | 0.01 | 187.0 | 7.06 |
| 1-methoxy-2-trifluoromethyl-1,3,3,3-tetrafluoro-1-propene | 44.5 | 933 | 0.00 | 154.6 | 7.09 |
| fluoromethyl 2,2,2-trifluoro-1-(trifluoromethyl)ethyl ether (SEVOFLURANE) | 59.0 | 1586 | 0.00 | 103.0 | 7.10 |
| (E)-2,3-dichlorohexafluoro-2-butene | 68.5 | 1104 | 0.00 | 72.4 | 7.15 |
| 2-bromo-3,3,4,4,4-pentafluorobutene | 66.1 | 84 | 0.01 | 10.5 | 7.19 |
| 3-bromo-2,3,4,4,4-pentafluorobutene | 69.7 | 84 | 0.01 | 4.9 | 7.20 |
| 4-bromo-2,3,3,4,4-pentafluorobutene | 69.2 | 84 | 0.01 | 6.0 | 7.21 |
| (Z)-1-(bromodifluoromethoxy)-1,2,3,3,3-pentafluoro-1-propene | 65.2 | 1334 | 0.01 | 70.1 | 7.22 |
| 3-bromo-3,3-difluoro-2-(trifluoromethyl)-propene | 49.7 | 733 | 0.01 | 15.0 | 7.24 |
| (Z)-1-bromo-1,1,4,4,4-pentafluoro-2-butene | 40.0 | 620 | 0.02 | 36.6 | 7.25 |
| (E)-1-(bromodifluoromethoxy)-1,2,3,3,3-pentafluoro-1-propene | 65.2 | 1334 | 0.01 | 70.1 | 7.25 |
| 3,3-dichloro-1,1,1,2,2-pentafluoropropane (HCFC-225) | 48.5 | 237 | 0.02 | 16.7 | 7.26 |
| 1-(bromodifluoromethoxy)-2-(trifluoromethyl)-3,3,3-trifluoro-1-propene | 78.3 | 2729 | 0.01 | 151.6 | 7.26 |

TABLE 1-continued

| CHEMICAL NAME | BP (C.) | GWP | ODP | $CS/CS_{113}$ | SP $(cal/cm^3)^{1/2}$ |
|---|---|---|---|---|---|
| methyl-1,1,2,2,3,3-hexafluoropropyl ether | 40.1 | 99 | 0.00 | 36.5 | 7.27 |
| trifluoroacetic anhydride | 40.2 | 97 | 0.00 | 236.9 | 7.29 |
| 2-bromo-1,1,2,2-tetrafluoroethoxy-trifluoroethene | 81.9 | 137 | 0.01 | 33.0 | 7.30 |
| 2,2-difluoroethyl-1,1,2,2-tetrafluoroethyl ether | 48.4 | 152 | 0.00 | 114.6 | 7.31 |
| 1,3-dichloro-1,1,2,2,3-pentafluoropropane (HCFC-225cb, AK-225G) | 52.7 | 350 | 0.02 | 9.2 | 7.31 |
| bis(2,2,2-trifluoroethyl)ether | 62.5 | 477 | 0.00 | 109.2 | 7.32 |
| methyl heptafluoropropyl ketone | 63.5 | 34 | 0.00 | 25.4 | 7.32 |
| (E)-1-bromo-1,1,4,4,4-pentafluoro-2-butene | 40.0 | 620 | 0.02 | 36.6 | 7.37 |
| difluoromethyl-2,2,3,3-tetrafluoropropyl ether | 49.8 | 152 | 0.00 | 109.9 | 7.44 |
| 4-bromo-3,3,4,4-tetrafluoro-1-butene | 55.0 | 69 | 0.01 | 5.8 | 7.44 |
| bis(difluoromethoxy)-tetrafluoroethane | 58.0 | 172 | 0.00 | 362.3 | 7.50 |
| 2-chloro-1,1,2-trifluoroethyl ethyl ether | 88.9 | 31 | 0.00 | 15.0 | 7.50 |
| 1-(2,2,2-trifluoroethoxy)nonafluoro-cyclohexene | 113.7 | 112 | 0.00 | 70.2 | 7.51 |
| 1,2-dichloro-3,3,4,4,5,5,6,6-octafluoro-cyclohexene | 123.8 | 30 | 0.00 | 15.5 | 7.55 |
| (Z)-1-bromo-1,2-difluoro-2-(2,2,2-trifluoroethoxy)-ethene | 87.9 | 140 | 0.00 | 52.7 | 7.61 |
| (bromodifluoromethyl)-pentafluorobenzene | 153.3 | 199 | 0.00 | 28.2 | 7.63 |
| (Z)-1-(bromodifluoromethoxy)-2-(trifluoromethyl)ethene | 57.8 | 240 | 0.02 | 54.3 | 7.63 |
| 2-bromoheptafluorotoluene | 151.3 | 199 | 0.00 | 21.5 | 7.64 |
| (2,2,2-trifluoroethyl)(2-bromo-2,2-difluoroethyl)ether | 73.0 | 240 | 0.02 | 52.1 | 7.64 |
| 3-bromoheptafluorotoluene | 153.0 | 199 | 0.00 | 21.1 | 7.66 |
| 4-bromoheptafluorotoluene | 151.3 | 199 | 0.00 | 37.9 | 7.66 |
| 1-(bromodifluoromethoxy)-1-(trifluoromethyl)ethene | 66.3 | 340 | 0.01 | 27.7 | 7.67 |
| ethyl-1,1,2,2-tetrafluoroethyl ether | 45.9 | 61 | 0.00 | 40.5 | 7.67 |
| perfluorotoluene | 104.0 | 335 | 0.00 | 64.0 | 7.70 |
| (E)-1-(bromodifluoromethoxy)-2-(trifluoromethyl)ethene | 57.8 | 240 | 0.02 | 54.3 | 7.73 |
| 1-bromo-2,4,6-tris(trifluoromethyl)benzene | 173.4 | 618 | 0.00 | 113.0 | 7.76 |
| methyl pentafluoropropanoate | 59.5 | 30 | 0.00 | 27.0 | 7.77 |
| 4-bromo-1,1,2,3,3-pentafluorobutene | 80.4 | 314 | 0.00 | 25.3 | 7.79 |
| (E)-1-(bromodifluoromethoxy)-2-(trifluoromethoxy)ethene | 76.5 | 682 | 0.02 | 144.9 | 7.79 |
| (Z)-1-(bromodifluoromethoxy)-2-(trifluoromethoxy)ethene | 76.5 | 682 | 0.02 | 144.9 | 7.79 |
| 1,1,4,4,4-pentafluoro-1-bromo-2-butanone | 89.0 | 340 | 0.01 | 17.1 | 7.89 |
| 1,1,5,5,5-pentafluoro-1-bromo-3-pentanone | 118.4 | 197 | 0.00 | 34.2 | 7.89 |
| 1,2-dichloro-hexafluoro-cyclopentene | 90.0 | 45 | 0.00 | 9.9 | 7.90 |
| 3-bromo-2,3,3-trifluoropropene | 41.6 | 101 | 0.02 | 6.1 | 7.66 |
| 3-bromo-1,3,3-trifluoropropene | 41.5 | 153 | 0.02 | 12.9 | 7.73 |
| 3-bromo-3,3-difluoro-1-propene | 42.0 | 66 | 0.02 | 5.9 | 7.89 |

We claim:

1. A solvent mixture comprising 60-99% of by weight of a main solvent and 1-40% by weight of a property-modification solvent, wherein:

the main solvent is selected from the group consisting of dipropyleneglycol dimethylether, 1-Bromo-2-methyl-propane, and 1-bromopropane, and the property-modification solvent is isoflurane.

2. A solvent mixture comprising 60-99 wt. % d-limonene, 1-40 wt. % isoflurane, 1-butanol, and R-134a.

3. The solvent mixture according to claim 2, wherein the solvent mixture comprises 65.4 wt. % d-limonene, 6.2 wt. % isoflurane, 5.4 wt. % 1-butanol, and 23 wt. % R-134a.

4. The solvent mixture according to claim 1, wherein the main solvent is dipropyleneglycol dimethylether.

5. The solvent mixture according to claim 4, wherein the solvent mixture further comprises 1-butanol.

6. The solvent mixture according to claim 1, wherein the solvent mixture consists essentially of 85 wt. % dipropyleneglycol dimethylether, 8 wt. % isoflurane and 7 wt. % 1-butanol.

7. The solvent mixture according to claim 1, wherein the main solvent is 1-Bromo-2-methylpropane.

8. The solvent mixture according to claim 7, wherein the solvent mixture further comprises n-propanol.

9. The solvent mixture according to claim 1, wherein the solvent mixture consists essentially of 45 wt. % 1-Bromo-2-methylpropane, 4 wt. % isoflurane and 5 wt. % n-propanol, and 46 wt. % R-134a.

10. A solvent mixture comprising 60-99% by weight of a main solvent and 1-40% by weight of a property-modification solvent, wherein the main solvent is 1-Bromo-3-chloropropane and the property-modification solvent is isoflurane.

11. The solvent mixture according to claim 10, wherein the solvent mixture further comprises ethanol.

12. The solvent mixture according to claim 11, wherein the solvent mixture further comprises R-134a and the solvent mixture consists essentially of 47 wt. % 1-Bromo-3-chloropropane, 5 wt. % isoflurane, 13 wt. % ethanol, and 35 wt. % R-134a.

13. A method of reducing the flammability of solvents containing brominated compounds by using R-134a as a propellant.

14. The solvent mixture according to claim 1, wherein the solvent mixture consists essentially of 45 wt. % 1-bromopropane, 4 wt. % isoflurane and 5 wt. % n-propanol, and 46 wt. % R-134a.

* * * * *